United States Patent [19]

Zoltan et al.

[11] Patent Number: 5,050,752

[45] Date of Patent: Sep. 24, 1991

[54] CHILD RESISTANT CONTAINER

[75] Inventors: Bart J. Zoltan, Old Tappan, N.J.; Roseamrie T. Specian, Mahopac, N.Y.; Linda A. Walker, Hawthorne, N.J.

[73] Assignee: American Cyanamid Company, Stamford, Conn.

[21] Appl. No.: 513,641

[22] Filed: Apr. 24, 1990

[51] Int. Cl.[5] ..... A61J 1/00

[52] U.S. Cl. ..... 215/206

[58] Field of Search ..... 215/201, 206; 70/287, 70/DIG. 32, DIG. 34

[56] References Cited

U.S. PATENT DOCUMENTS

| | | | |
|---|---|---|---|
| Re. 31,101 | 12/1982 | Berghahn | 206/1.5 |
| 446,657 | 2/1881 | Baum . | |
| 3,313,441 | 4/1967 | Fadden | 215/206 |
| 3,405,828 | 10/1968 | Pierre | 215/206 |
| 3,421,347 | 1/1969 | Sotory | 70/63 |
| 3,669,296 | 6/1972 | Drew et al. | 215/206 |
| 3,850,324 | 11/1974 | Meyer | 215/206 |
| 4,234,093 | 11/1980 | Tyson | 206/536 |
| 4,393,977 | 7/1983 | Willingham | 215/211 |
| 4,412,625 | 11/1983 | Zander | 215/223 |
| 4,527,547 | 12/1986 | Cooke | 215/222 |
| 4,572,376 | 2/1986 | Wrennall | 206/538 |
| 4,611,727 | 9/1986 | Graff | 221/154 |
| 4,616,752 | 10/1986 | Ridgley | 206/533 |
| 4,741,433 | 5/1988 | Irvine | 206/1.5 |
| 4,779,747 | 10/1988 | Morel | 215/206 |

*Primary Examiner*—Stephen Marcus
*Assistant Examiner*—Nova Stucker
*Attorney, Agent, or Firm*—Thomas S. Szatkowski

[57] ABSTRACT

A container for pills and medicines which is child resistant but is also readily accessible to the elderly or infirm is provided. The container features two or more easy to manipulate two position switches having sufficient width or spacing to accommodate swollen fingers.

6 Claims, 6 Drawing Sheets

CHILD RESISTANT CONTAINER

BACKGROUND OF THE INVENTION

1. Field of the Invention

The invention relates to a container for pills and medicines which is child resistant but is also readily accessible to the elderly or infirm, especially those who have impaired use of their fingers due to diseases such as rheumatoid arthritis, osteoarthritis, parkinsonism, muscular dystrophy, cerebral palsy, myasthenia gravis, stroke, among others.

2. Description of the Prior Art

Child resistant containers are known. Most existing child resistant containers require the user to execute a physical maneuver which is practical for a healthy adult but not for a child. Typically, a two or three step sequence must be followed such as "push down, turn and open". Executing such a sequence is very difficult for the elderly or infirm and nearly impossible for those with debilitating diseases, such as rheumatoid arthritis, which result in sublexation of the fingers.

It has recently been reported that many of the healthy elderly are unable to open and reclose the child-resistant closures dispensed by most pharmacies. Many such patients open or have someone open their medication for them and leave the medication container opened, taking their medication as needed. Reports from the Center for Disease Control, disseminated by the Consumer Product Safety Commission at a meeting of the American Society for Testing and Materials in 1985, indicate that a large fraction of child poisoning by ingestion of prescribed pharmaceuticals occurs in the home of a grandparent who has left the child resistant medication container in an unsecured position. Because of this finding it is anticipated that the government regulation regarding child resistance, Title 16 CFR part 1700 will be expanded to include the test of an older population for their ability to open and to resecure the child resistant features. It is thus an object of the present invention to provide a container which is child resistant but also accessible to the elderly or infirm.

One approach to providing a child resistant pill container which is accessible to the elderly or handicapped is found in U.S. Pat. No. 4,412,625. This patent describes a three sided container which is opened by a two step procedure: first pushing the cap portion laterally relative to the container and then rotating the cap to reveal the opening This requires a great deal of strength to open (column 3 line 62 to column 4 line 2) however, it does not require a great deal of manual dexterity. Nevertheless, this approach is not considered to be satisfactory for many of the elderly or infirm who lack both strength and manual dexterity.

Another approach to providing a child resistant container which is readily openable by infirm adults, such as arthritics, is found in U.S. Pat. No. Re 31,101. This patent discloses a container having a cap which can only be removed by applying pressure to the underside of the cap. Access to the underside of the cap is offered only through an enclosed channel which is longer than the length of the finger of a child but not longer than the finger of an adult. This approach, however, is not considered to be satisfactory for many of the elderly or infirm whose fingers have considerable swelling or deformation due to disease such as rheumatoid arthritis.

Yet another approach to providing child resistant containers is found in U.S. Pat. No. 3,421,347. This patent, not specifically directed to the elderly or infirm, discloses a container having a plurality of moveable rotatable ring elements which must be particularly positioned to allow removal of the cover of the container. Each ring element has a series of numbers imprinted on it. The user positions each ring element by aligning the proper number corresponding to the solution of an arithmetic equation imprinted on the container. This container would be particularly difficult for the elderly or infirm to use as it involves precisely aligning the rings via small handles which are difficult to grip and manipulate into the desired positions. Another drawback to U.S. Pat. No. 3,421,347 is that the closure described would be costly to manufacture and to assemble.

SUMMARY OF THE INVENTION

It has been found that a container employing two or more easy to manipulate, two position switches is both child resistant and readily accessible to the elderly or infirm, especially those having impaired use of their fingers due to diseases such as rheumatoid arthritis, osteoarthritis, parkinsonsim, muscular dystrophy, cerebral palsy, myasthenia gravis, or stroke, among others. The switches are of sufficient width or spacing to accommodate swollen fingers, are made of materials having a low coefficient of friction and are mounted in such a way as to move easily with little resistance thus requiring minimal effort or force to manipulate. Each switch is mounted to move between two positions: one which permits the opening of the container and another which prevents the opening of the container. Each switch is associated with indicia for each position, either directly upon the switch, or next to and associated with each side of the switch. In order for the container to be opened all of the switches must be aligned in the position which permits opening. The child resistant feature is provided by the instructions which describe how to align all of the switches in the position which permits opening in a manner comprehendible to an adult but not to a child.

DESCRIPTION OF THE PREFERRED EMBODIMENTS

Figure 1:
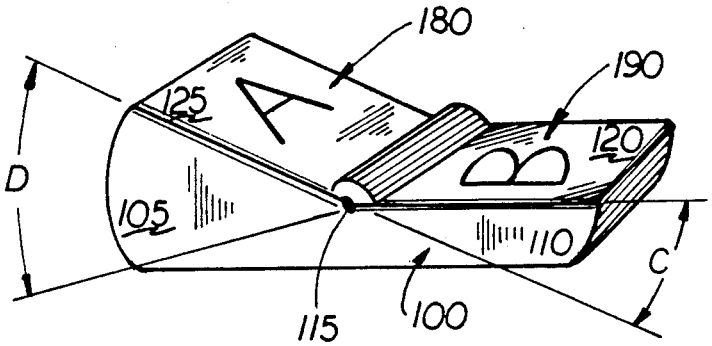
FIG. 1 depicts one embodiment of a switch according to the present invention.

Referring to FIG. 1, two position switch 100, is non-symmetrical, having one side 105 angle D in any case subtending a larger angle, from about 10 to 90 degrees, than the other side 110, angle C which may in preferred designs subtend from 1 to 45 degrees. The switch is capable of being mounted so as to pivot about pivot axis 115. The switch faces 120 and 125 are sized to have sufficient length and width for use by someone having little or no dexterity in their fingers or swollen fingers. Further, switches 100 are spaced sufficiently apart to allow an adult finger, especially a finger swollen by disease, to depress and manipulate one switch only, without depressing any adjacent switches. Each face of the switch 120 and 125 have associated with them indicia 190 and 180. Alternatively indicia 190 and 180 may be on the container directly adjacent to the switches. The materials are of low coefficient of friction, and are mounted so as to yield little resistance to being moved from one position to another.

Figure 2:
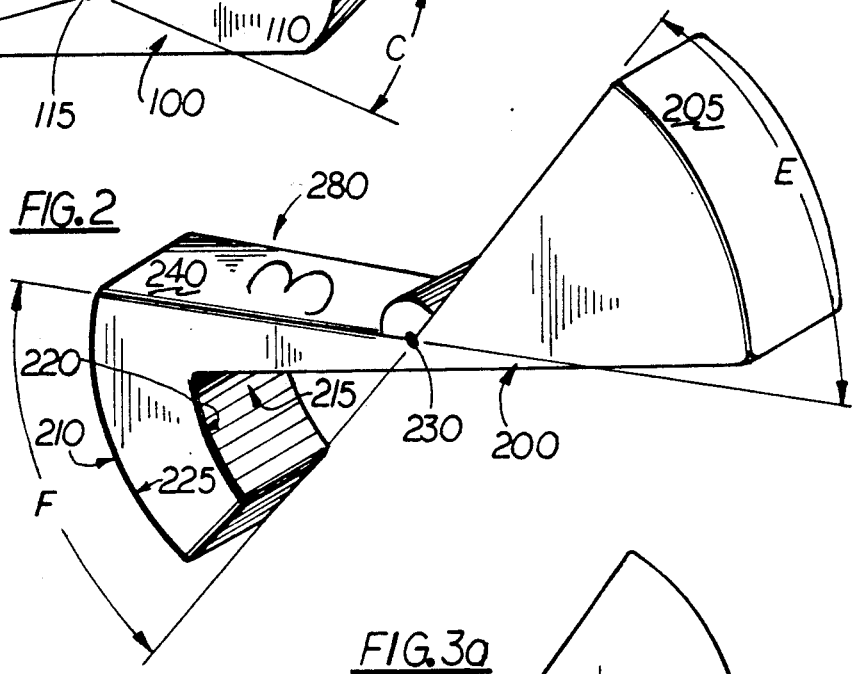
FIG. 2 depicts another embodiment of a switch according to the present invention.

FIG. 2 shows an alternative two position, non-symmetrical switch 200. In this alternative switch arrangement, the angles E and F subtended by the two outer perimeter segments 205 and 210 respectively can be identical and in preferred designs can range from about 15 to about 90 degrees. The difference between the two sides of the switch is in the interior surface 215, on one side of the switch. This surface is created by removing a segment of one side of the switch, this segment being pie shaped, and having a radius 220 which is less than the outer radius 225. One face 240 of the switch is shown with indicia 280 visible. The switch is pivotably mounted about axis 230, and is made of materials, such as selected plastics having a low coefficient of friction, which allow ease of rotation about the pivot axis.

Figure 3A:
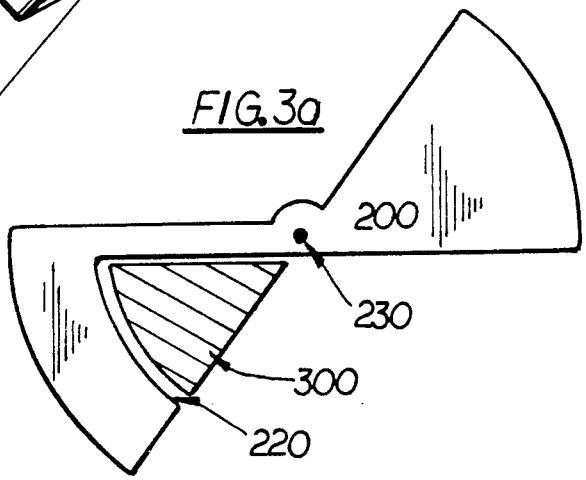
FIG. 3*a* depicts the switch in FIG. 2, in one of its two positions.
Figure 3B:
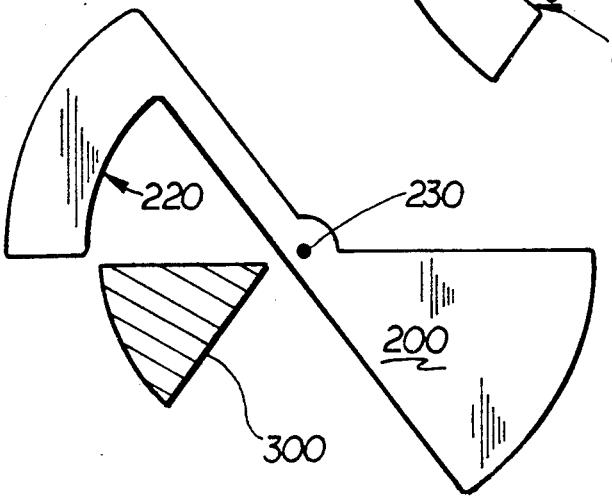
FIG. 3*b* depicts the switch in FIG. 2, in the second of its two positions.

FIG. 3*a* shows the two position switch 200 of FIG. 2, in its prevent opening position. A solid element 300 is located so as to be capable of being located under the arc defined by curvature 220. FIG. 3*b* shows the two position switch 200 of FIG. 2, in its permit opening position. The solid element 300 is no longer engaged under curvature 220. The discussion to follow will explain the exact nature of element 300, and its position in a typical child resistant closure according to this invention.

Figure 4A:
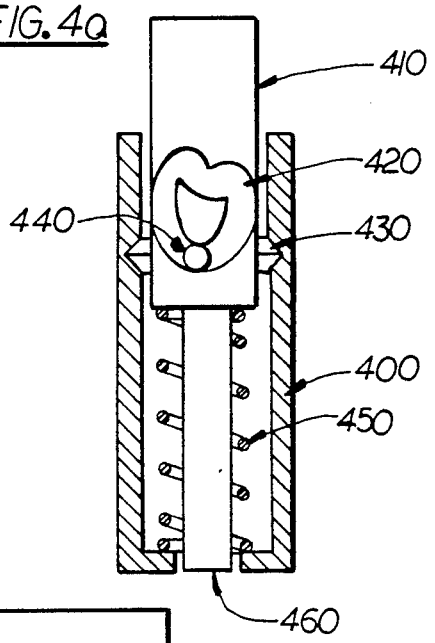
FIG. 4*a* depicts a two position linear switch in its withdrawn position.
Figure 4B:
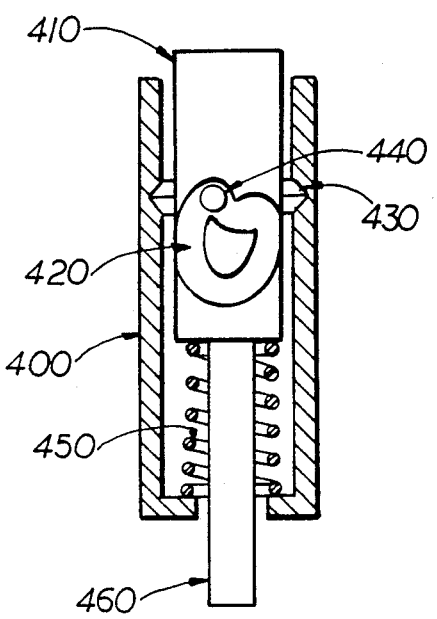
FIG. 4*b* depicts a two position linear switch in its extended position.

FIGS. 4*a* and 4*b* show an in-line two position switch, of a type commonly used in ball point pens, electrical switches and some toys. Push-button 410 has a heart shaped cam recess 420. Sleeve 400 has a circular internal groove 430, and a special steel ball 440 is captured between the heart shaped cam recess 420 and the circular groove 430. Spring 450 acts to provide a bias force against push-button 410, and to maintain the position of the steel ball 440 in cam recess 420. When push-button 410 is pressed, the steel ball rotates in the clockwise direction in the heart-shaped cam recess 420, while remaining also in cylindrical groove 430. The position of the ball 440 within the heart-shaped cam recess 420 determines the position of plunger 460. FIG. 4*a* shows the ball 440 in the plunger 460 retracted position. When the push-button 410 is depressed the ball 440 goes to the top holding position of the heart-shaped cam recess 420. It is maintained there by the pressure of the spring 450. When the push-button 410 is pressed again, the ball 440 goes to the bottom holding point of the cam recess 420, and the plunger 460 is retracted back into the body of the two position switch.

Figure 5:
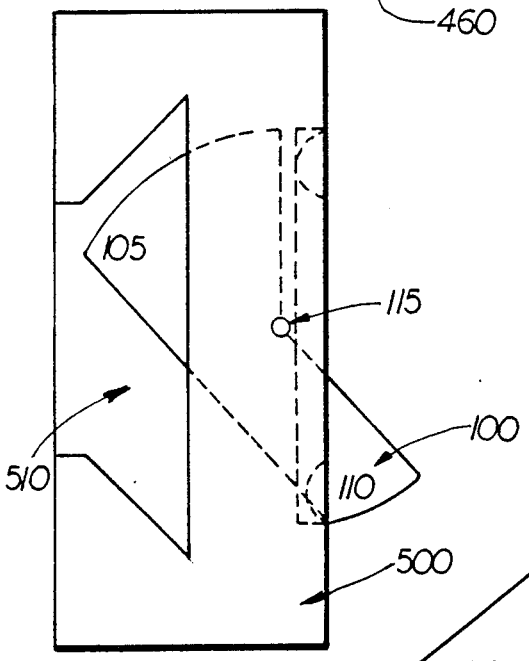
FIG. 5 depicts the switch shown in figure one, used in conjunction with a slideably removable closure.

FIG. 5 shows the switch 100 of FIG. 1, configured in a slideable closure 500. In the position shown, the prevent opening position, section 105 of switch 100 extends into aperture 510, which as shown has a dove-tail configuration. When end 110 of switch 100 is depressed, section 105 is withdrawn from aperture 510. For clarity, one two position switch is shown, but it should be apparent that a plurality of such switches can be used.

The containers can be of any reasonable size and shape. For the purpose of illustration the containers are shown as rectangular, but they could in fact be circular, or have any other shape, so long as the container is capable of being opened, and has a feature into which a plurality of interlocking members can be attached.

Figure 6:
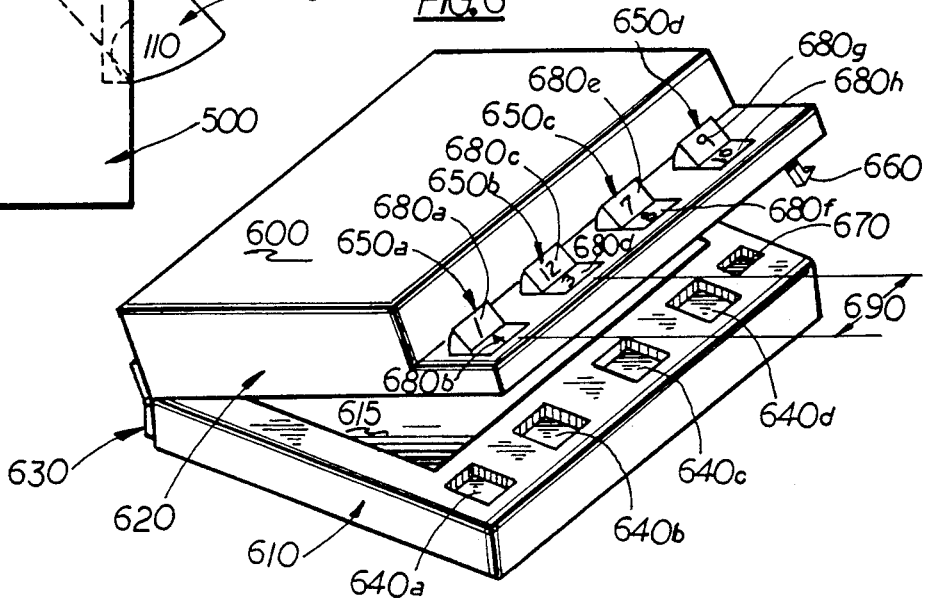
FIG. 6 depicts one embodiment of a container according to the present invention.

FIG. 6 shows one embodiment of the container 600 of this invention. The container is comprised of lower half 610, having a depressed portion 615 therein to receive and store the material to be contained, and an upper half 620, which may optionally also have a depressed portion similar to that in lower half 610. The two halves 610 and 620 are hingeably connected by way of hinge 630. For this application the hinge 630 must be made of a slightly compliant material, such as a thin piece of plastic, or an elastic material attached by way of an adhesive, or bonding. This embodiment uses the two position switches 100, described in FIG. 1. When a switch is in the permit opening position, it is flush with, or withdrawn into upper half 620. When the switch is in the prohibit opening position, it extends into openings 640*a*, 640*b*, 640*c*, or 640*d* in the lower half of the container. Openings 640*a*, 640*b*, 640*c*, and 640*d* are located directly below switches 650*a*, 650*b*, 650*c*, and 650*d*. As before, each position of the two position switch is marked by indicia, in this example digits. In this embodiment, the hinge axis defined by 630, is parallel to the pivot axis of switches 650*a*, 650*b*, 650*c*, and 650*d*. Thus, with this arrangement of axes, regardless of the position of the switches, whether they extend into lower half 610 or not, the container can still be opened. For this reason a feature 660 is included on upper half 620. Feature 660 is a flexible hooked member, capable of being hooked onto feature 670 in lower half 610. In order to open container 600, it is necessary to rotate upper half 620, clockwise relative to lower half 610, and it is for this reason that in this embodiment hinge 630 has to be sufficiently compliant to allow for this rotation. In use, if any of the two position switches 650*a*, 650*b*, 650*c*, or 650*d* in the prevent opening position, it is not possible to rotate the upper half or the container relative to the lower half. Thus, all of the switches must be in the permit opening position before the container can be opened, and its contents can be gained. This embodiment can easily be manipulated by a patient with severe loss of dexterity of the fingers. The distance between the centers of adjacent two position switches 690 is such that the finger of an adult can depress one switch without also depressing any adjacent switch.

Figure 7:
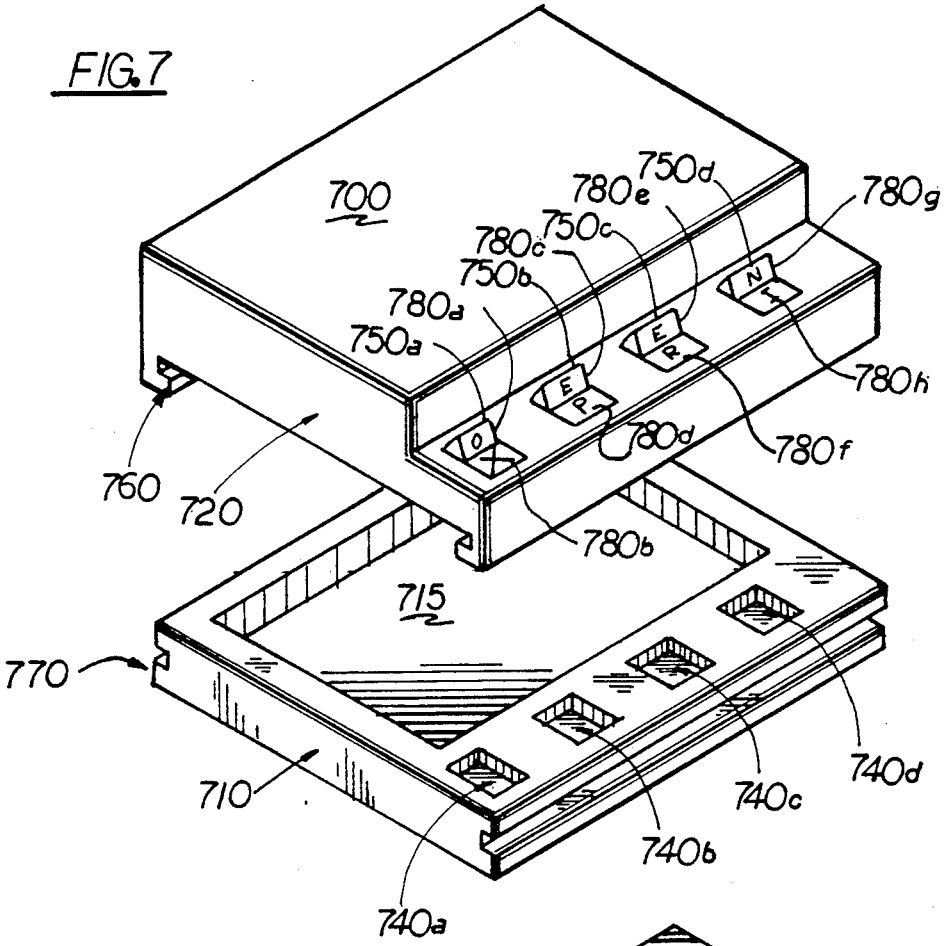
FIG. 7 depicts another embodiment of a container according to the present invention.

FIG. 7 is another embodiment of the invention. Container 700 is comprised of two separate halves, lower half 71O, and upper half 720. Two position switches, according to FIG. 1, 750*a*, 750*b*, 750*c* and 760*d* are located in the upper half 720. When a switch is in the permit opening position, it is flush with the upper half 720, or is withdrawn into upper half 720. When the switch is in the prohibit opening position, it extends into openings 740*a*, 740*b*, 740*c*, or 740*d* in the lower half of the container. Openings 740*a*, 740*b*, 740*c*, and 740*d* are located directly below switches 750*a*, 750*b*, 750*c*, and 750*d*. Each position of the switch is associated with indicia 780*a*, 780*b*, 780*c*, 780*d*, 780*e*, 780*f*, 780*g*, and 780*h*, in this embodiment letters of the alphabet. In this embodiment the upper piece 720 has a tab like feature by 760, which is slideably engagable to track like feature 770 on the lower half 710. When and only when all of the two position switches are in the permit opening positions can the container be opened by sliding the upper half relative to the lower half. In this embodiment, the container can be made of any number of materials, such as plastic, wood, or even metal. The relative motion between the two halves can be gained by a severely arthritic person, since it is not necessary to grasp the two halves, it is sufficient to place ones palms over the top and bottom, and to slide over relatively to the other.

Figure 7A:
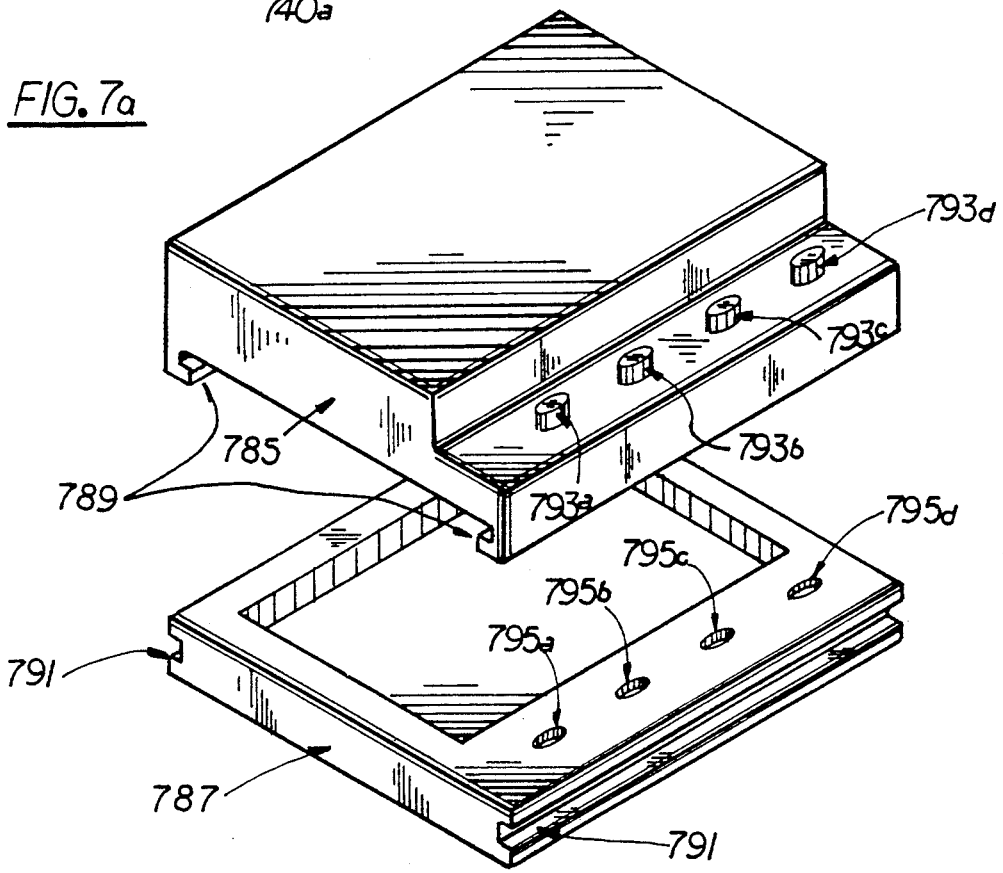
FIG. 7*a* depicts another embodiment of a container according to the present invention.

FIG. 7*a* depicts another embodiment of a package wherein the container is comprised of two (2) halves, the upper half 785 being attached to the lower half 787, and the upper half having features 789, with these upper half mating features being slideably engaged to lower half 787, the lower half having grooves 791 sized to match the mating features of the upper half. The upper half 785 contains two-positions linear switches 793*a*, 793*b*, 793*c*, 793*d*. In the permit opening position the switches 793*a*, 793*b*, 793*c*, and 793*d* are withdrawn into the upper half 785. In the prohibit opening position, one on several of the switches protrude into apertures 795*a*, 795*b*, 795*c*, and 795*d* in the lower half 787.

Figure 8:
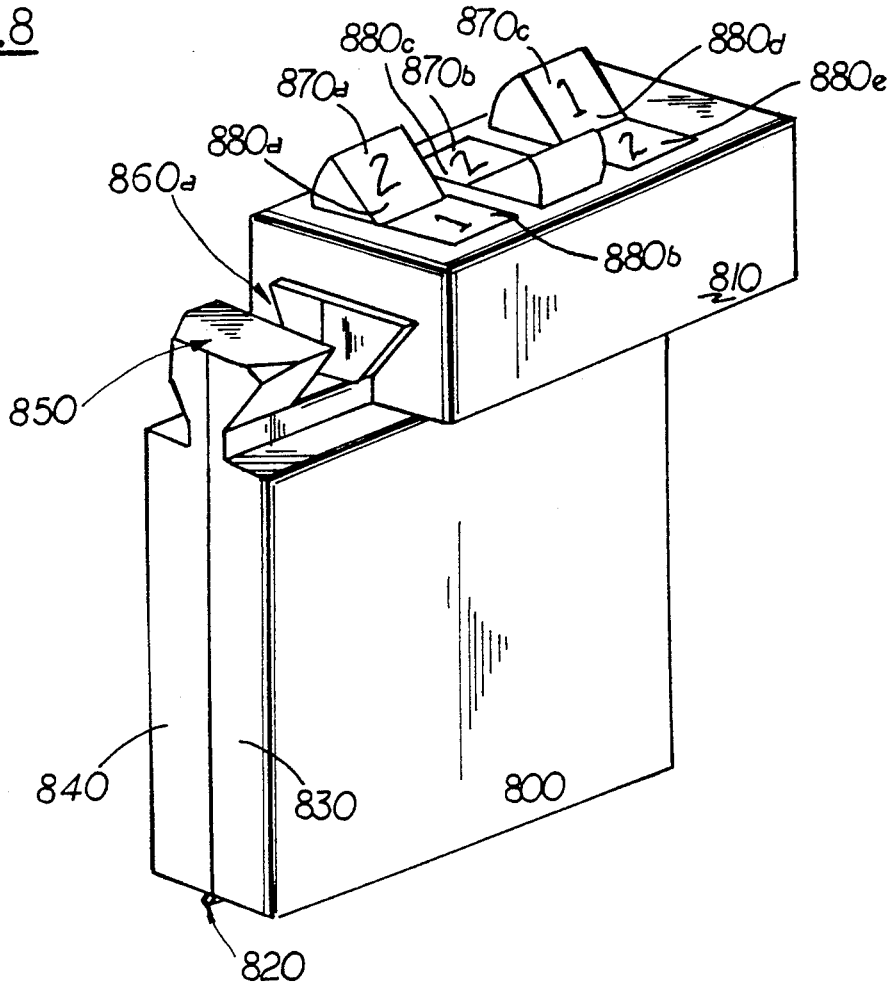
FIG. 8 depicts another embodiment of a container and a closure according to the present invention.

FIG. 8 depicts another embodiment wherein the closure 810 is a piece separate from the container 800. The container 800 is capable of being opened about rigid hinge 820. Either of the halves 830 or 840, or both may have a depression therein for the purpose of holding the medicament or product to be kept in the child resistant container. At the face opposite the side having the hinge, the container has a dovetail like feature. This feature is divided by the parting line between the two halves 830 and 840, and further contains an aperture such as 860*a*, and in this embodiment two other apertures which are not visible in this view, but would be 860*b* and 860*c*. The closure 810 contains a plurality of two position switches 870*a*, 870*b*, and 870*c*, and also an opening along its long axis which matches the dovetail feature of the container. The switches are marked with indicia 880*a*, 880*b*, 880*c*, 880*d*, and 880*e* for the positions visible in this view. In this embodiment the indicia are digits. When the closure is on the container, the two position switches are aligned with the apertures in dovetail 850. When any of the two position switches is in a position such that it is within the apertures in dovetail 850, the closure cannot be removed from the container. Because the switches are large, and because the motion of the closure relative to the container is easily achieved, this design is easy to use by the elderly or infirm.

Figure 9:
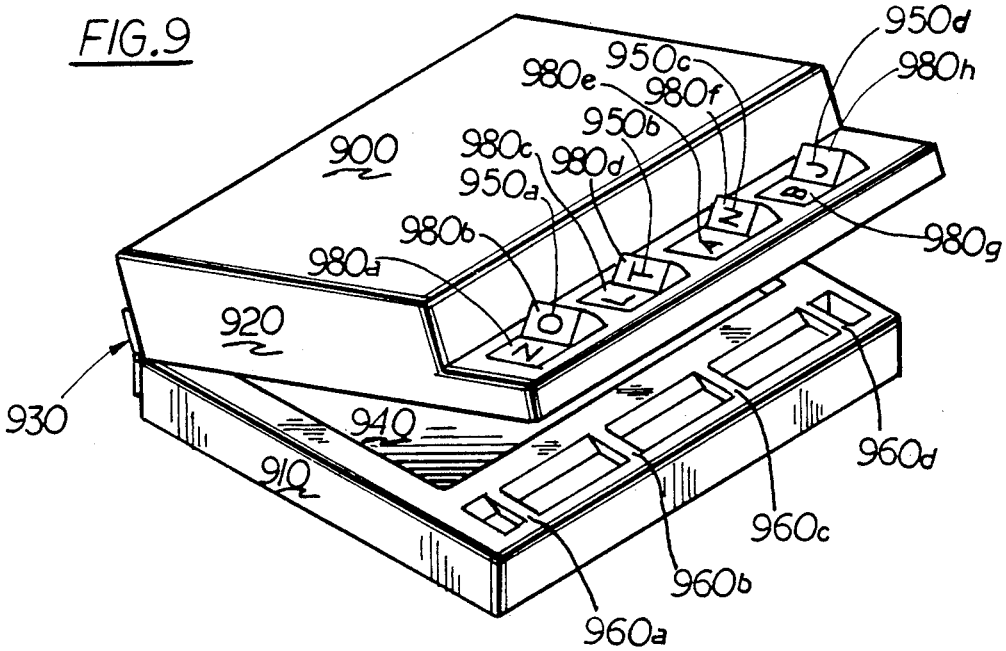
FIG. 9 depicts another embodiment of a container according to the present invention.

FIG. 9 depicts an alternative embodiment of the invention, using the switch shown in FIGS. 2, 3*a*, and 3*b*. In this embodiment container 900 has a lower half 910 and an upper half 920. Lower half 910 contains a depression 940 for holding a medicament, and upper half 920 may optionally have a similar depression. The two halves are joined by a rigid hinge 930, which allows the container to be opened and closed. The upper half contains switches of the type depicted in FIGS. 2, 3*a*, and 3*b*. The pivot axes of these switches is perpendicular to the hinge axis 930. The switches 950*a*, 950*b*, 950*c*, and 950*d* are capable of being withdrawn flush with or into upper half 920. In the lower half 910, cross members 960*a*, 960*b*, 960*c*, and 960*d* are capable of being engaged with switches 950*a*, 950*b*, 950*c*, and 950*d* respectively. The switch positions are marked by indicia 980*a*, 980*b*, 980*c*, 980*d*, 980*e*, 980*f*, 980*g*, and 980*h*, in this example letters. In this embodiment, if any of the switches is in the prevent opening position, the upper half 920 in incapable of being opened by being rotated about hinge 930 relative to lower half 910.

The unique nature of the child resistant feature of the subject invention is that while it is designed to be particularly easy to use by patients who have limited manual dexterity it is still child resistant. This is accomplished by utilizing the difference in the mental acuity of the adult individual trying to gain access to the contents as compared to a child. The instructions for opening are written upon the closure or the container. They are of a level of complexity as to be comprehendible to adults, but not to children.

Figure 10:
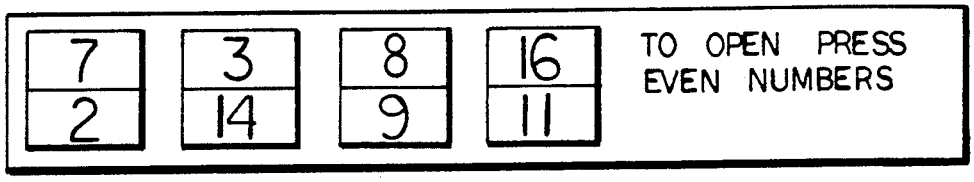
FIG. 10 depicts an array of two position switches with their indicia, and the instructions for setting the switches to the permit opening position.
Figure 11:
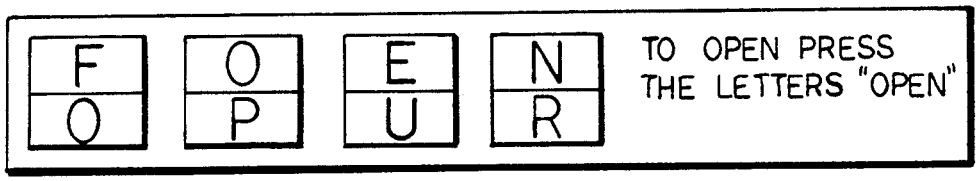
FIG. 11 depicts an array of two position switches with their indicia, and the instructions for setting the switches to the permit opening position.
Figure 12:
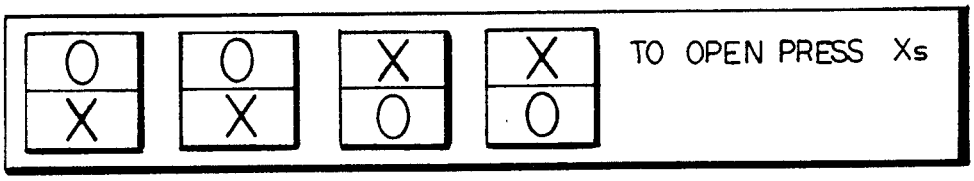
FIG. 12 depicts an array of two position switches with their indicia, and the instructions for setting the switches to the permit opening position.
Figure 13:
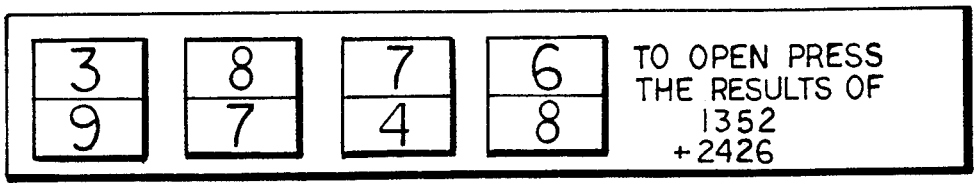
FIG. 13 depicts an array of two position switches with their indicia, and the instructions for setting the switches to the permit opening position.
Figure 14:
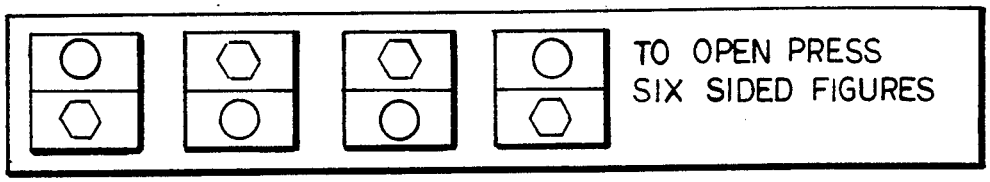
FIG. 14 depicts an array of two position switches with their indicia, and the instructions for setting the switches to the permit opening position.
Figure 15:
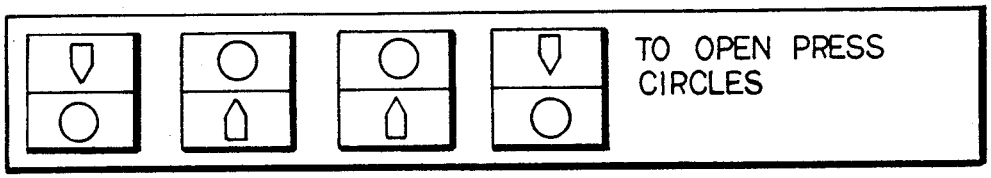
FIG. 15 depicts an array of two position switches with their indicia, and the instructions for setting the switches to the permit opening position.
Figure 16:
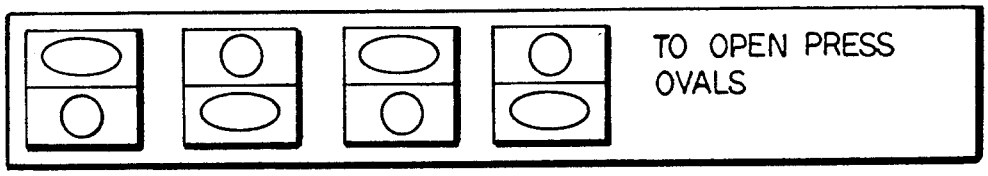
FIG. 16 depicts an array of two position switches with their indicia, and the instructions for setting the switches to the permit opening position.
Figure 17:
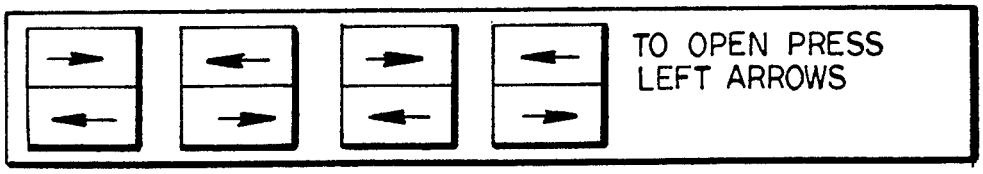
FIG. 17 depicts an array of two position switches with their indicia, and the instructions for setting the switches to the permit opening position.

FIGS. 10 through 17 show various examples of typical instruction sets which would render the package child-resistant. FIG. 10 requires the user to know what even numbers are, and to be able to select them. The instructions in FIG. 11 calls for the user to spell an easy word, "open". FIG. 12 merely requires the user to depress all the Xs, and therefore is likely to be less effective in selecting out adults since children may duplicate the pattern while playing. The instructions in FIG. 13 require the user to add two four-digit numbers with a carry, and is likely to be very effective in keeping children out, but would be difficult for some adults. FIGS. 14 and 15 show instructions like those in FIG. 12, except these instructions describe the shape to be selected, instead of also showing a picture of the shape. The instructions in FIG. 16 require the user to select an unusual shape, while FIG. 17 calls for a match in the directions of multiple arrows.

We have built two (2) prototypes of the invention, as depicted in FIG. 8, with the instructions as shown in FIG. 10. As the data below shows, older patients find the subject containers much easier to open than the standard pharmaceutical closures currently in use. The reason for this is the size and relative location of the switches, and the fact that there is no need for manual dexterity in opening the containers of the subject invention.

The prototypes were tested on 24 "senior" users by an independent laboratory specializing in evaluating child resistant packaging. The users received no instructions other than the markings on the package. All of the users were able to open the package within the allotted time, and all but one were able to resecure the package. These results, projected within the limits of the new "seniors" testing protocol currently under consideration by the Consumer Product Safety Commission, would pass protocol.

TEST DATA
(Senior Users)

| | |
|---|---|
| Number of subjects: | 24 |
| Male: | 5 |
| Female: | 19 |
| Average age: | 59.875 |
| Number opened package in less than 60 seconds: | 17 |
| Number opened package in less than 180 seconds: | 19 |
| Number opened package in less than 300 seconds: | 24 |
| Number resecured package in less than 60 seconds: | 20 |
| Number resecured package in less than 180 seconds: | 23 |
| Number resecured package in less than 300 seconds: | 23 |
| Number unable to resecure package: | 1 |
| Subjects preferring this package to existing child-resistant packages: | 13 |
| Subjects preferring existing child-resistant packages to this package: | 5 |
| Subjects responding both were similar: | 0 |
| Subjects not responding to question: | 6 |

Note:
Subjects who usually do not receive their medication in a child-resistant package (6) were instructed not to respond to this question.

The following are comments from the test subjects: "Easier to manipulate"; "I have trouble with arthritis. Much easier to open. Doesn't need improvement"; like its "safety and ease to open"; "easier to open"; "easy"; "hate it, don't make it"; "greatest, easy to read, easy to open"; "I can lock it and not breaking nails in process"; "get rid of it"; "easier"; "piece of junk"; "good idea for people with arthritis"; and "this is great, easy on my hands, don't need to push and turn".

The prototypes were also tested on 24 children according to the protocol set forth in 16 CFR 1700 by the same independant laboratory. Of the 24 children, none could gain access within the alloted time. These results show that a package according to the present invention is unexpectedly easy to open for senior users but also child resistant.

We claim:

1. A container for medicines, said container being child resistant but accessible to the elderly or infirm, which comprises:

enclosure means for surrounding said medicine;

a plurality of two position switch means cooperating with said enclosure means, said switch means comprising switches adapted so as to pivot about an axis between two discreet positions, said switch means positioned sufficiently apart to allow the elderly or infirm to manipulate one switch without affecting any adjacent switch, each of said switch means being of sufficient size to be easily manipulated by the elderly or infirm between said two discreet positions, one discreet position permitting opening of the enclosure means and the other discreet position preventing opening of the enclosure means;

engaging means cooperating with said enclosure means and said switch means to prevent opening when one or more of said switch means are in the prevent opening position and to allow opening when all of said switch means are in the permit opening position; and instruction means comprehendible to an adult but not to a child for describing how to position all of the switch means in the permit opening position.

2. A container for medicines, said container being child resistant but accessible to the elderly or infirm, which comprises:

a first portion containing a plurality of two position switch means, said switch means positioned sufficiently apart to allow the elderly or infirm to manipulate one switch without affecting any adjacent switch, each of said switch means being of sufficient size to be easily manipulated by the elderly on infirm, said first portion further comprising engagement means for slideable attachment with a second portion;

a second portion containing a plurality aperture means for engaging said switch means, said aperture means positioned so as to cooperate with said switch means and further containing engagement means for slideable attachment with said first portion;

said first and second portions defining a cavity for holding said medicine, said cavity being accessible by sliding one portion transversely relative to the other;

each of said two position switch means adapted to be manipulated between two positions one position preventing sliding of the first and second positions relative to each other by engagement between said switch means and said aperture means and the other position permitting sliding of the first and second positions relative to each other due to lack of engagement between? said switch means and said aperture means; and instruction means comprehendible to an adult but not to a child for describing how to position all of the switch means to the permit opening position.

3. The container according to claim 2 wherein each of said two position switch means comprises a non symmetrical switch having two faces pivotably mounted in the center between the two faces.

4. The container according to claim 2 wherein said two position switch means comprises an in line push button two position switch.

5. A container for medicines, said container being child resistant but accessible to the elderly or infirm which comprises;

a first and second portion hingeably attached to each other, said first and second position defining a cavity for holding said medicine, said cavity being accessible by moving one portion away from the other;

a plurality of two position switch means located on one portion said switch means positioned sufficiently apart to allow the elderly or infirm to manipulate one switch without affecting any adjacent switch, each of said switch means being of sufficient size to be easily manipulated by the elderly or infirm;

a plurality of engagement means located on the other portion in such a manner so as to cooperate with said switch means;

each of said two position switch means adopted to be manipulated between two positions, one position preventing opening of the two portions by engagement of said switch means with said engagement means, the other position permitting opening of the two portions due to lack of engagement between said switch means and said engagement means; and instruction means comprehendible to an adult but not to a child for describing how to position all of the switch means to the permit opening position.

6. The container according to claim 5 when said switch means comprises an asymmetrical switch pivotably mounted and containing a hook for engaging the engaging means.

* * * * *